United States Patent [19]

Temme et al.

[11] Patent Number: 4,620,394

[45] Date of Patent: Nov. 4, 1986

[54] DEVICE FOR SLIDE GRINDING

[75] Inventors: Karl Temme, Wuppertal; Volker Mehnert, Gevelsberg, both of Fed. Rep. of Germany

[73] Assignee: Carl Kurt Walther GmbH & Co. KG, Wuppertal, Fed. Rep. of Germany

[21] Appl. No.: 729,595

[22] Filed: May 2, 1985

[30] Foreign Application Priority Data

May 12, 1984 [DE] Fed. Rep. of Germany ..... 3417749
Nov. 26, 1984 [DE] Fed. Rep. of Germany ..... 3442996

[51] Int. Cl.[4] ..... B24B 19/00
[52] U.S. Cl. ..... 51/163.2; 51/7
[58] Field of Search ..... 51/163.1, 163.2, 7, 51/164.1

[56] References Cited

U.S. PATENT DOCUMENTS 3,073,078 1/1963 Balz ..... 51/163.1
4,001,979 1/1977 Elkins ..... 51/163.2
4,115,960 9/1978 Zecher ..... 51/163.1
4,363,194 12/1982 Balz ..... 51/163.1
4,380,137 4/1983 Balz ..... 51/163.1

*Primary Examiner*—Harold D. Whitehead
*Attorney, Agent, or Firm*—Martin A. Farber

[57] ABSTRACT

An apparatus for slide grinding has a slide-grinding container which is movable upwardly from a slide-grinding position thereof around a horizontal tilt axis into an emptying position thereof above a screen which is adapted to be placed in vibration and is arranged in an upper region of a collection container which is tiltable into an emptying position above the slide-grinding container. A collection chamber of the collection container below the screen has a first chute which terminates above the slide-grinding container in the emptying position of the collection chamber. The chute defines an emptying opening for returning abrasive bodies which have fallen through the screen into the slide-grinding container. The slide-grinding container and the collection container are individually tiltable and the screen is developed as a screen chute which vibrates relative to the collection container.

14 Claims, 11 Drawing Figures

DEVICE FOR SLIDE GRINDING

FIELD AND BACKGROUND OF THE INVENTION

The present invention relates to an apparatus for slide grinding having the slide-grinding (slide-abrasive) container which is movable upwards from its slide-grinding position around a horizontal tilt axle into the emptying position above a screening path which, in its turn, is tiltable upwards into an emptying position above the slide-grinding container in slide-grinding position and extends over a collection chamber for abrasive bodies, the bottom of which chamber is developed as a slide which extends over the slide-grinding container.

One such construction is known from U.S. Pat. No. 4,380,137 in which a guide wall which is spaced from the tilt axle extends at right angles from the upper edge of the container. Said wall extends parallel to the screening path which is present on the other side of the tilt axle. This development has the disadvantage that after the treatment of the workpieces and the following swinging of the slide-grinding container into the emptying position, the workpieces plus grinding bodies fall over the guide wall onto the screening path. Since the drop path is relatively long, this can lead to damage in the case of delicate workpieces. Furthermore, the construction of the apparatus is expensive.

Constructions are also known in which the screening path and the slide-grinding container are located one above the other, and the emptying and separating processes take place in the manner that the contents of the container are first of all transferred into a loading box and then tilted from the latter onto the screening path for separation. As a result of this design, an additional part in the form of the loading box is necessary.

SUMMARY OF THE INVENTION

The object of the invention is to so develop an apparatus of the aforementioned type that gentle treatment of the workpieces is obtained during the emptying of the slide-grinding container, while retaining its simple construction.

This object is achieved, on the one hand, by the slide-grinding container (10) and the collection container (25) being individually tiltable and the screen (41) being developed as a screen chute (37) which vibrates relative to the collection container.

As a result of this development, an apparatus of this type of increased value in use is created. The apparatus itself is of simple construction. The workpieces can no longer be damaged upon the emptying of the slide-grinding container. When said container is brought into the emptying position, the contents of the container, consisting of workpieces and abrasive bodies, pass first of all onto the slide surface and then onto the flap which closes the emptying opening of the collection chamber. From here the contents of the container are conducted directly to the screening path, without any endangering drop step. The workpieces are removed, while the abrasive bodies fall through this screen into the collection chamber. After separation, the slide-grinding container returns into its initial basic position and the collection chamber swings into a return position, the abrasive bodies then sliding through the emptying opening into the slide-grinding container.

It is furthermore favorable for a partial section of the circumferential surface of the shaft forming the tilting axis to be developed as a transition slide surface from the slide-grinding container to the screening slide. The contents of the container therefore, upon the emptying of the slide-grinding container, pass over a true slide path without disturbing drops. The treatment of the workpieces is therefore particularly gentle. Furthermore, the tilt axis as a result also serves a two-fold function.

Another advantage is with the screening path developed as a chute which is separate from the collection chamber, supported thereon by spring action and equipped with a vibratory drive. Accordingly, the collection chamber need no longer also be placed in oscillation, so that the vibratory drive operates with good separation while requiring little power. In order that the abrasive bodies which pass through the screening path are dependably collected, the screen chute extends over a part of the length of the upper edge region of the downwardly tapering collection chamber, the latter having an emptying opening on its bottom, said opening being closed by a bottom flap which is hinged for swinging movement. This flap is brought into the open position when the abrasive bodies are to be removed. Complete emptying can be effected in a short time.

Advantages also result from the fact that the closure flap of the emptying opening is hinged at its end facing away from the tilt axis and that its freely movable end which faces the tilt axis lies within a recess formed by the formation of a step. During the emptying of the slide-grinding container, the flap, as a result of gravity, is in its position which closes the emptying opening of the collection chamber. When, however, the abrasive bodies move back from the collection chamber into the slide-grinding container, the abrasive bodies thus swing open the flap and can accordingly flow through the emptying opening into the slide-grinding container. Accordingly, no separate control for the closure flap is needed. Another advantageous feature resides in the fact that a slide surface which terminates at the level of a partial section of the shaft obtusely adjoins the upper edge of the slide-grinding container, and the closure flap of the emptying opening is so coordinated to the shaft that the shaft lies in the manner of a roof ridge with respect to the closure flap and the slide surface. The contents of the container are accordingly guided directly over the shaft in the emptying position. This applies also to the abrasive bodies upon their return from the collection chamber into the slide-grinding container.

On the other hand, by the features that the tilt axis (108) of the slide-grinding container (104) is arranged on the collecting-chamber-side of the vertical central axis (x—x) and the tilt axis (109) of the collection chamber (105) is arranged on the slide-grinding-container side of the vertical central axis (x—x) of the machine frame (103), the problem indicated at the start is solved.

This development is characterized in particular by a simplified construction. The slide-grinding container and collection chamber now swing independently of each other around their tilt axles. The tilting of slide-grinding container and collection chamber around separate axles permits optimal emptying positions. This means that the corresponding parts are capable of swinging through a large angle, effecting a complete emptying. The emptying positions can be so selected that the forces coming from the collection chamber and the slide-grinding container are introduced into the tilt axles. It is possible to tilt the slide-grinding container and/or collection chamber into the dead center position and then beyond it into the emptying position. Furthermore, the development of the invention makes it possible that there are no paths of sudden drop which lead to damage to the workpieces.

One advantageous further development resides in the fact that the tilt axle of the collection chamber is located at a higher level than the tilt axle of the slide-grinding container. It is furthermore an advantage that the edge of the slide-grinding container is provided with a chute over the part of its periphery facing the machine frame. The chute has the result that, upon the tilting of the slide-grinding container into the emptying position, the contents of the container are transferred completely to the screening path. The return of the machining bodies from the collection chamber, which has been brought into the tilted position, in this way takes place on the prescribed path. From a structural standpoint, it is favorable for the machine frame to be developed as column between slide-grinding container and collection chamber. For the gentle discharge of the workpieces it is advantageous for the chute to be tiltable over a ramp which descends obliquely to the screening path and lies above the emptying chute. The contents of the container therefore pass onto this ramp before reaching the screening path.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
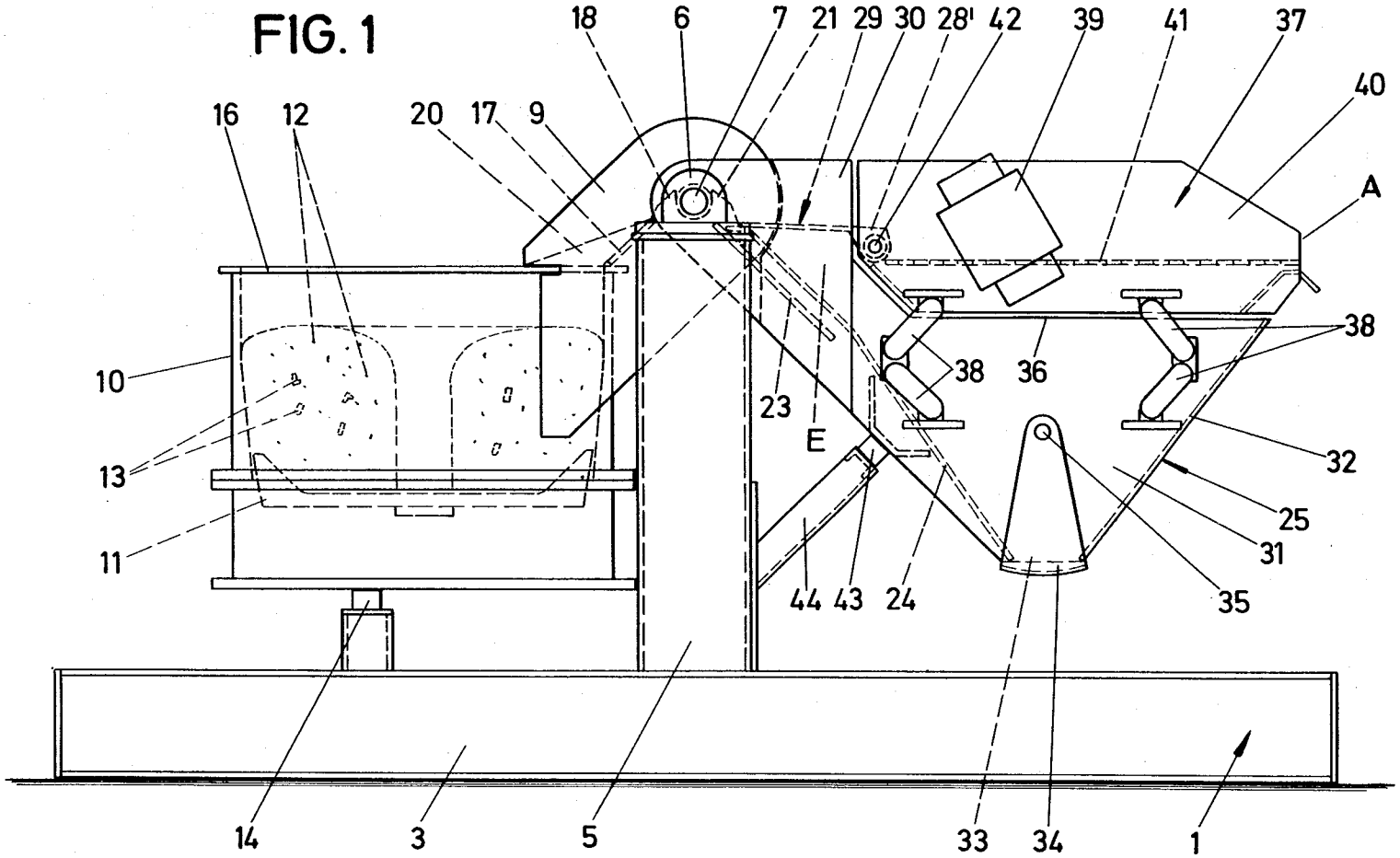
FIG. 1 is a side view of the apparatus in accordance with the first embodiment, seen in the grinding position.
Figure 2:
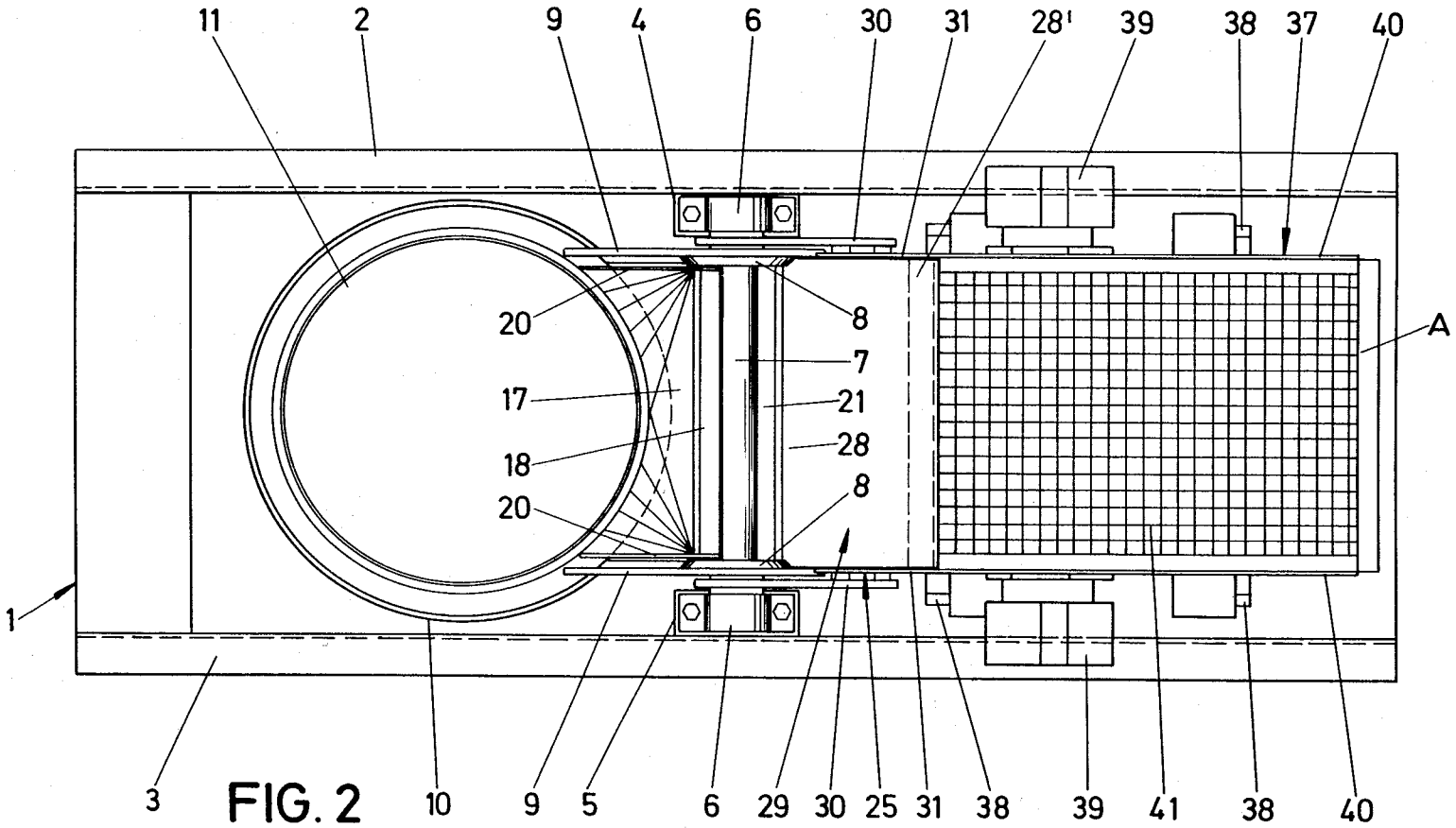
FIG. 2 is a top view of the apparatus.
Figure 3:
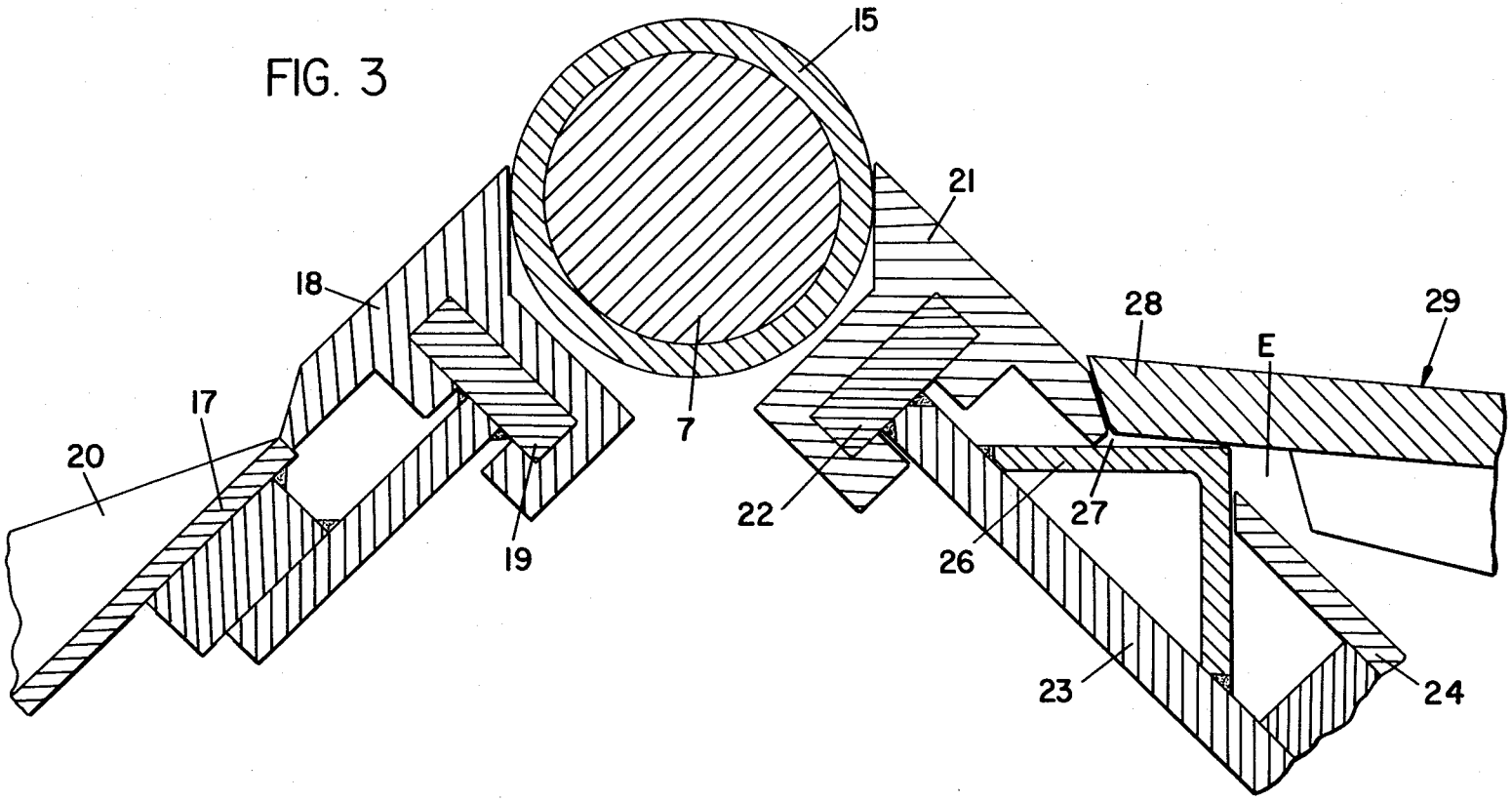
FIG. 3 shows, on approximately true scale, a longitudinal section in the region of the tilt axle corresponding to the position shown in FIG. 1.

The apparatus in accordance with the first embodiment, shown in FIGS. 1 to 7, has a rectangularly shaped base frame 1. From the two lengthwise beams 2, 3 thereof there extend, at the center, upwardly directed columns 4, 5, each of which has a shaft bearing 6 on its top. A shaft 7 forming the tilt axis is mounted in said bearings.

Near the bearings 6 collars 8 which are connected to arms 9 are swingably seated on the shaft 7. The arms 9 extend from a slide-grinding container 10 of circular cross section. The bottom of said container is formed by a rotary plate 11 which is placed in rotation by a drive, not shown in the drawing. When the slide-grinding container 10 assumes the grinding position shown in FIG. 1 and the rotary plate 11 is driven, the contents of the container consisting of abrasive grinding bodies 12 and workpieces 13, present in the slide-grinding container are moved in a helical path, producing a slide abrasive grinding of the workpieces 13. In the grinding position, the slide-grinding container 10 rests on stops 14 extending from the base 1.

The region of the shaft 7 which extends between the bearing collars 8 is surrounded by a jacket 15 formed by plastic. A slide surface 17 substantially at the tangent level of a portion of the cylindrical surface of the shaft 7 obtusely adjoins the upper edge 16 of the slide-grinding container 10. Between the jacket 15 and the slide surface 17 there is interposed a sealing lip 18 which rests closely against the jacket 15 and is borne by a rail 19 which is fastened on the bottom of the slide surface 17. The slide surface 17 is shaped as a linear portion in the region of the sealing lip 18 and transfers into the round shape of the slide-grinding container 10. Side walls 20 which exert a guide function are bent off at an angle from the slide surface 17.

On the side of the tilt axis 7 opposite the slide-grinding container 10 there is another sealing lip 21. It is seated on a rail 22 of a supporting plate 23 which is fastened in the region of the bottom 24 of a collection chamber 25. The sealing lip 21 bridges over the distance between the shaft 7 and an angle plate 26 fastened to the inside of the supporting plate 23. In this way, a recess 27 is formed by formation of a step between the angle plate 26 and the sealing lip 21, in which recess the freely movable end 28 of a closure flap 9 which closes the emptying opening E of the collection chamber 25 lies. The sealing lips 18, 21 as well as the width of the closure flap 29 and also of the collection chamber correspond approximately to the distance between the bearing collars 8. As can be noted in particular from FIG. 3, the shaft 7 extends in the manner of a roof ridge with respect to the closure flap 29 and the slide surface 17.

In addition to the slide-grinding container 10, the collection chamber 25 is also arranged swingably around the shaft 7. For this purpose, the collection chamber 25 is provided on the end facing the shaft 7 with bearing lugs 30 which are connected in suitable manner, with the side walls of the collection chamber 25.

The side walls 31 are arranged vertically, while the bottom 24 and the opposite bottom wall 32 extend in tapered form downwardly. The bottom emptying opening 33 provided there is closed by a bottom flap 34. The latter is hinged for swing-like movement around journal pins 35 on the side walls 31 of the collection chamber.

The upper edge region of the side walls 31 is cut away adjoining the bearing lugs 30. The space created by the recess 36 formed thereby serves for providing a screen path which is formed as a chute 37 which is separated from the collection chamber 25 and supported there by spring action. For this purpose, spring elements 38 are fastened both to the collection chamber 25 and to the screen chute 37. The screen chute is placed in oscillation by vibratory drives 39 arranged outside the chute 37. A screen 41 is held between the side walls 40 of the chute 37. This screen extends up to the end 28' of the closure flap 29 facing away from the tilt axis 7. Said end 28' is seated on a shaft 42 mounted in the side walls 40.

That end of the screening chute 37, developed as 9 transport path, which is arranged opposite the tilt axis 7 accordingly forms a workpiece discharge opening A.

The basic position of the collection chamber 25 is defined by stops 43 which are fastened on arms 44 on the columns 4, 5.

Figure 4:
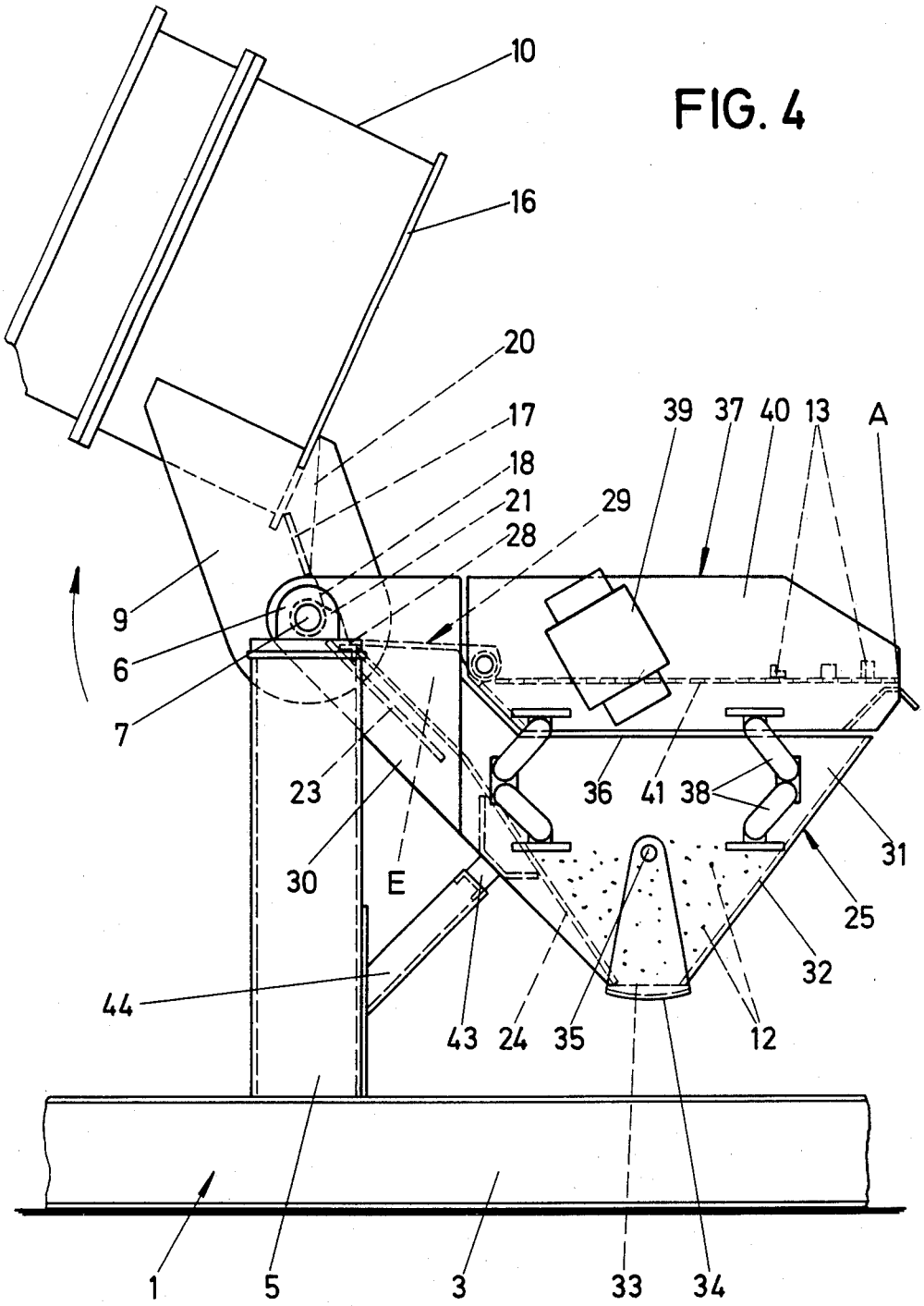
FIG. 4 is a view corresponding to FIG. 1, in which the slide-grinding container has been swung into the emptying position.
Figure 5:
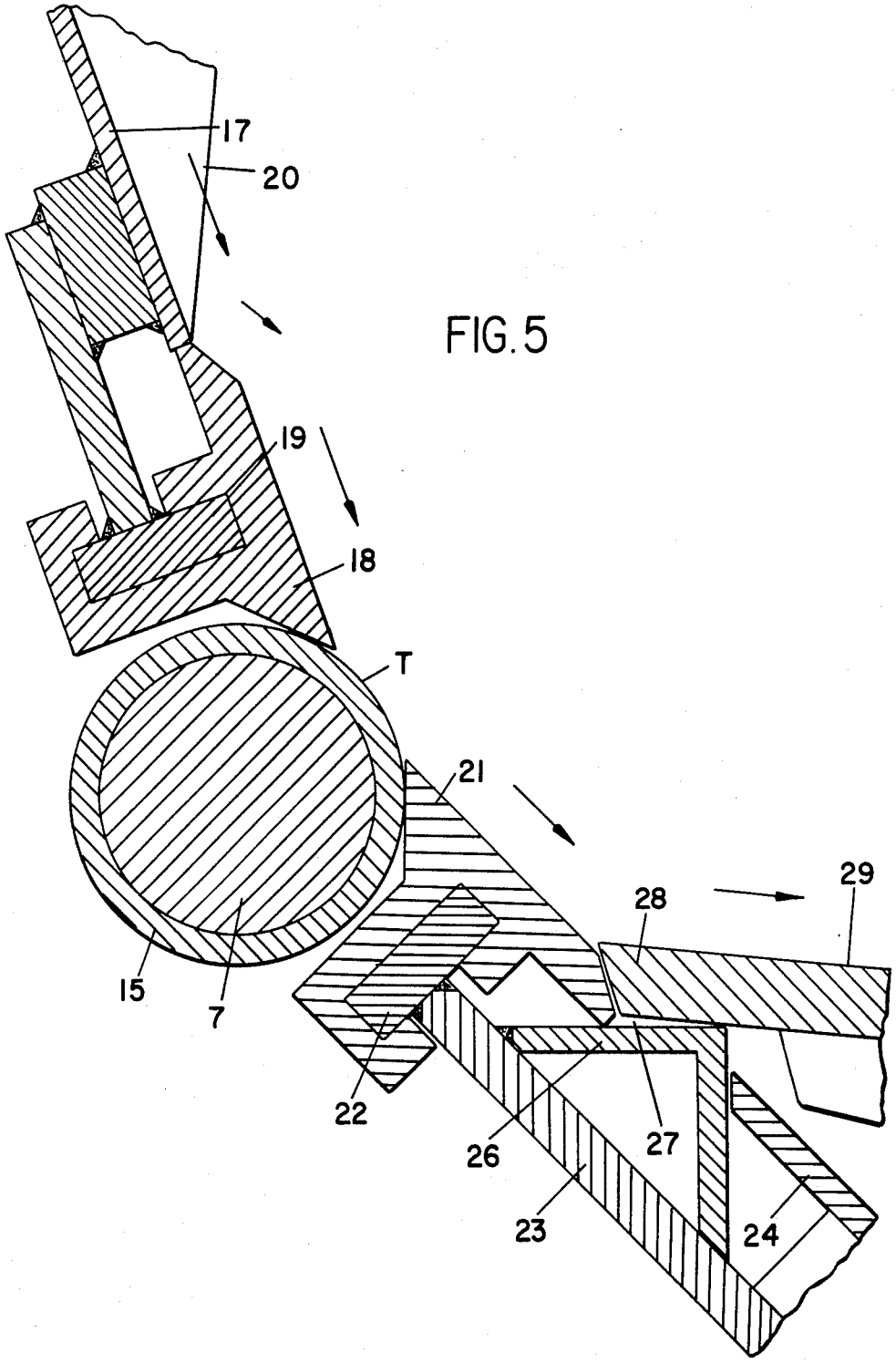
FIG. 5 is a cross section thereof through the apparatus in the region of the tilt axis.

When the workpieces 13 present in the slide-grinding container 10 are to be emptied from the slide-grinding container 10 after suitable surface treatment, the container is swung into the position shown in FIG. 4. This can be done by means of an incorporated drive or a separate drive. The slide surface 17 and the sealing lip 18 come into the position shown in FIG. 5 and the contents of the container now flow, in the direction indicated by the arrows, over the sealing lips 18, 21 to the closure flap 29 which closes the emptying opening E. A partial section T of the cylindrical surface of the shaft 7 which forms the tilt axis serves, in this connection, as a transition slide surface from the slide-grinding container 10 to the screening chute 37. Since the latter is placed in vibration, the abrasive bodies 12 drop through the screen 41 while the workpieces 13 travel in the direction towards the workpiece discharge-opening A.

Figure 6:
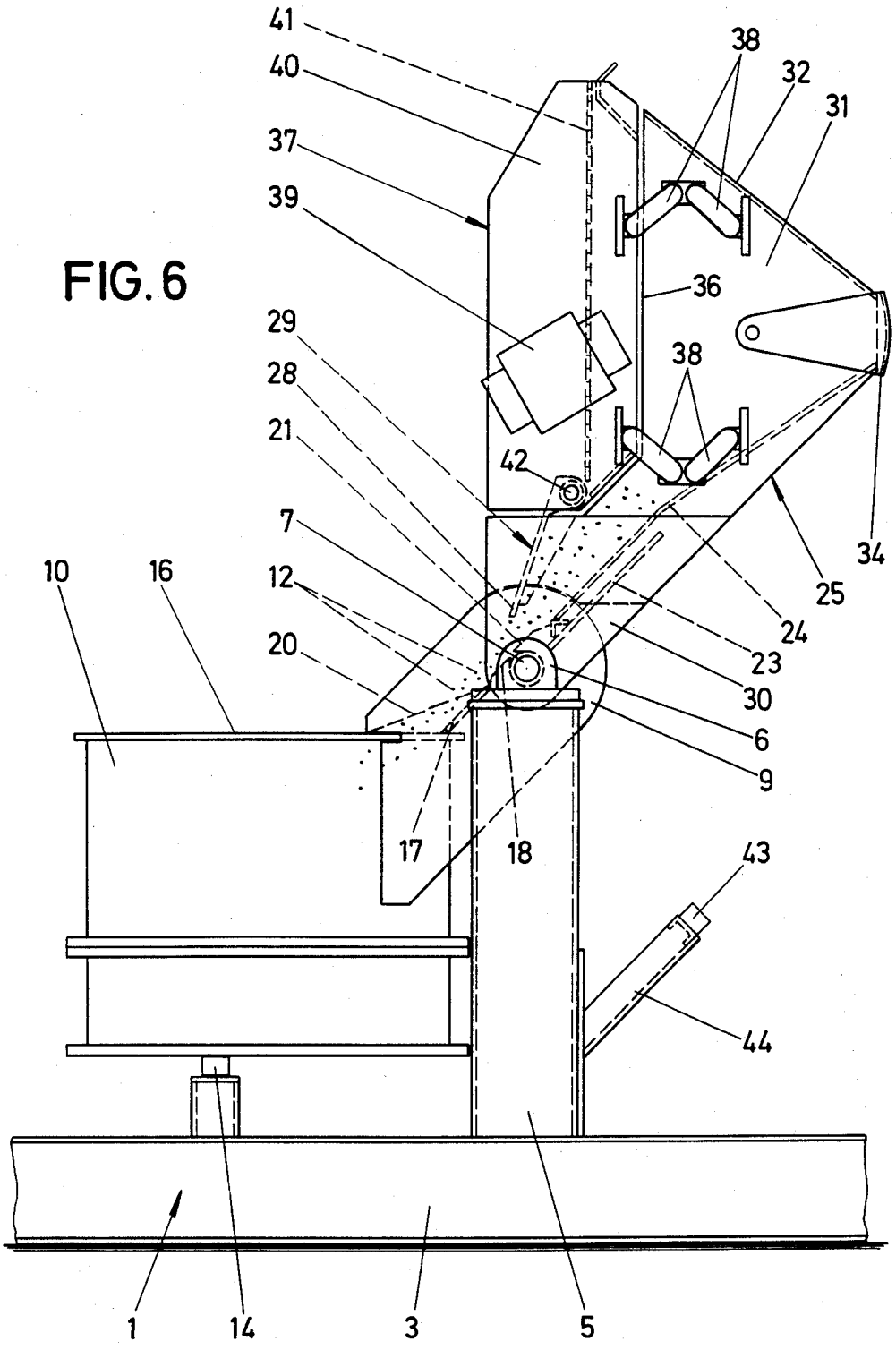
FIG. 6 is a view, corresponding to FIG. 1, in which the collection chamber has been swung into the return position.
Figure 7:
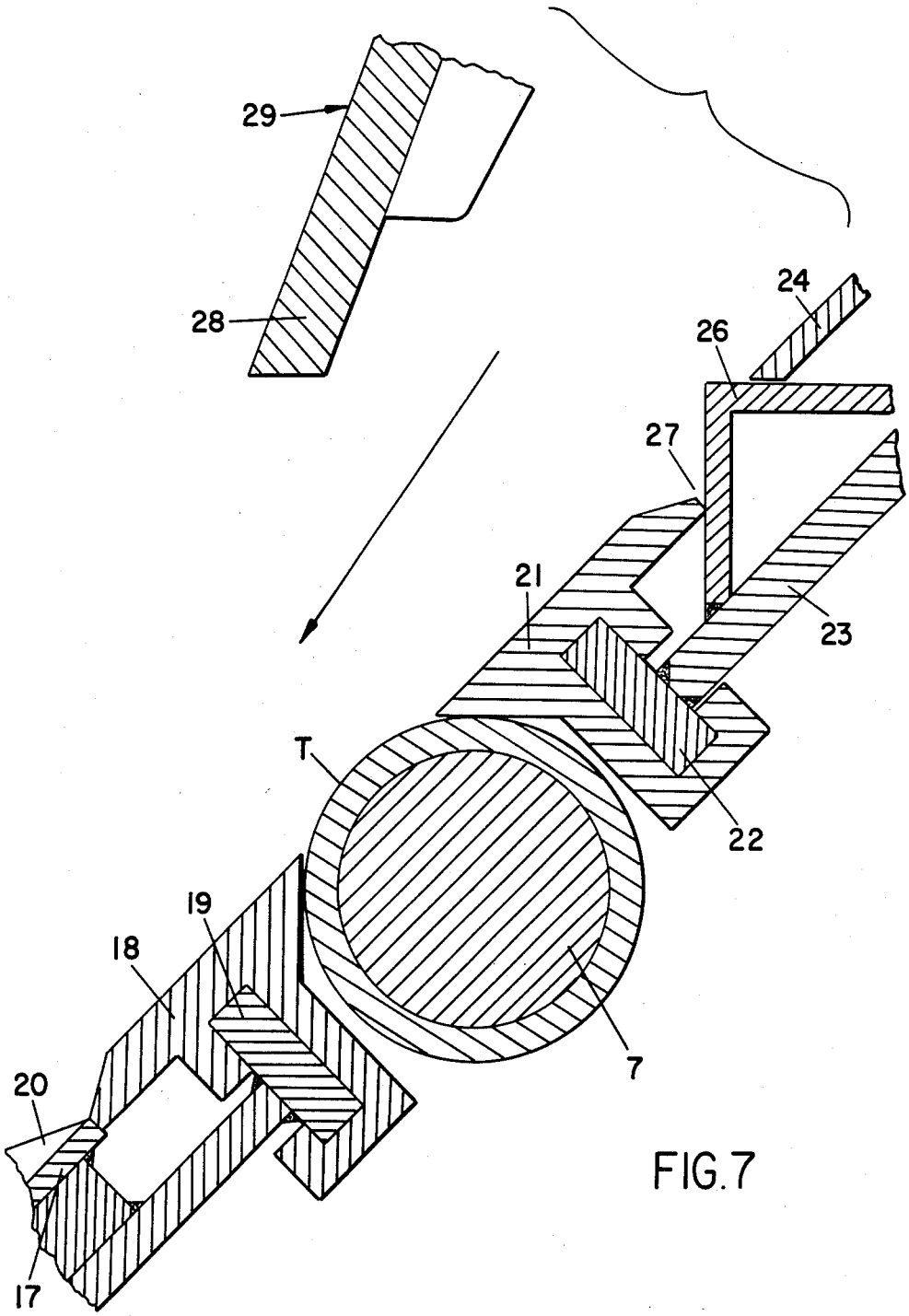
FIG. 7 is a corresponding cross section in the region of the tilt axis.

After the separation has been effected, the slide-grinding container 10 and the collection chamber 25 are swung into the position shown in FIGS. 6 and 7. The potential energy inherent in the slide-grinding container 10 can be utilized in this connection to raise the collection chamber 25, whereby the corresponding energy requirement is reduced. The abrasive bodies 12 can now flock back from the collection chamber 25 through the emptying opening E into the slide-grinding container 10. The closure flap 29, which is pivoted for free swinging, necessarily moves outward at the same time. In the return position, the sealing lips 18, 21 are aligned with each other, leaving free a partial section T of the shaft 7 which serves as transition slide surface for the abrasive bodies. When the abrasive bodies have been returned, the collection chamber 25 can be moved back into the basic position shown in FIG. 1 and the workpieces can again be introduced into the slide- grinding container, so that the next machining operation can start.

The machining may also be effected from time to time with the addition of liquid substances.

Since the tilt axis 7 is arranged approximately tangentially to the slide-grinding container 10 and is approximately at the height of the upper edge of the container, and the flap leading to the screening chute adjoins the tilt axis 7, very gentle treatment of the workpieces can be obtained upon the emptying of the slide-grinding container 10.

The apparatus in accordance with the second embodiment, shown in FIGS. 8 to 11, has two lengthwise beams 101, 102 arranged parallel to each other and forming support feet, a machine frame 103 extending at the center from them. The machine frame is developed as column between a slide-grinding container 104 and a collection chamber 105. The machine frame 103 consists in this connection of two vertically standing individual columns 106, 107 which are parallel to each other.

At their upper end the individual columns 106, 107 are provided with a tilt axis 108 for the slide-grinding container 104 and a tilt axis 109 for the collection chamber 105. The tilt axis 109 of the collection chamber 105 is higher than the tilt axis of the slide-grinding container 104. The distance apart in vertical direction between the tilt axes is less than the horizontal distance between the tilt axes. The tilt axis 108 of the slide-grinding container 104 is arranged on the collection chamber side and the tilt axis 109 of the collection chamber 105 is arranged on the slide-grinding container side of the vertical central axis x—x of the machine frame 103.

Two bearing lugs 110 extend parallel to each other from the slide-grinding container 104, which is of circular cross section. Said bearing lugs lie flat against the inner walls of the columns 106, 107 and continue at the end into an upward-directed bend 110'. At the end region of this bend 110', the tilt axis 108 is provided. The bottom of the slide-grinding container 104 forms a rotary plate 111 which is placed in rotation by a drive, not shown. In the grinding position, the slide-grinding container 104 which receives the grinding bodies 112 and workpieces 113 rests on stops 114 which extend from the longitudinal beams 101, 102.

The collection chamber 105 is also supported by two bearing lugs 115 which are parallel to each other. They, however, rest against the outer wall of the individual columns 106, 107. The bearing lugs 115 are connected in suitable fashion with the side walls 116 of the collection chamber 105. The side walls 116 taper down towards their lower end and, in combination with a bottom 117 and a bottom wall 118, form a collection chamber 105 of funnel shape, leaving an outlet opening 119 on the bottom side. The latter is closed by a bottom flap 120 which is pivoted for swinging motion around journal pins 121 on the side walls 116 of the collection chamber.

Figure 8:
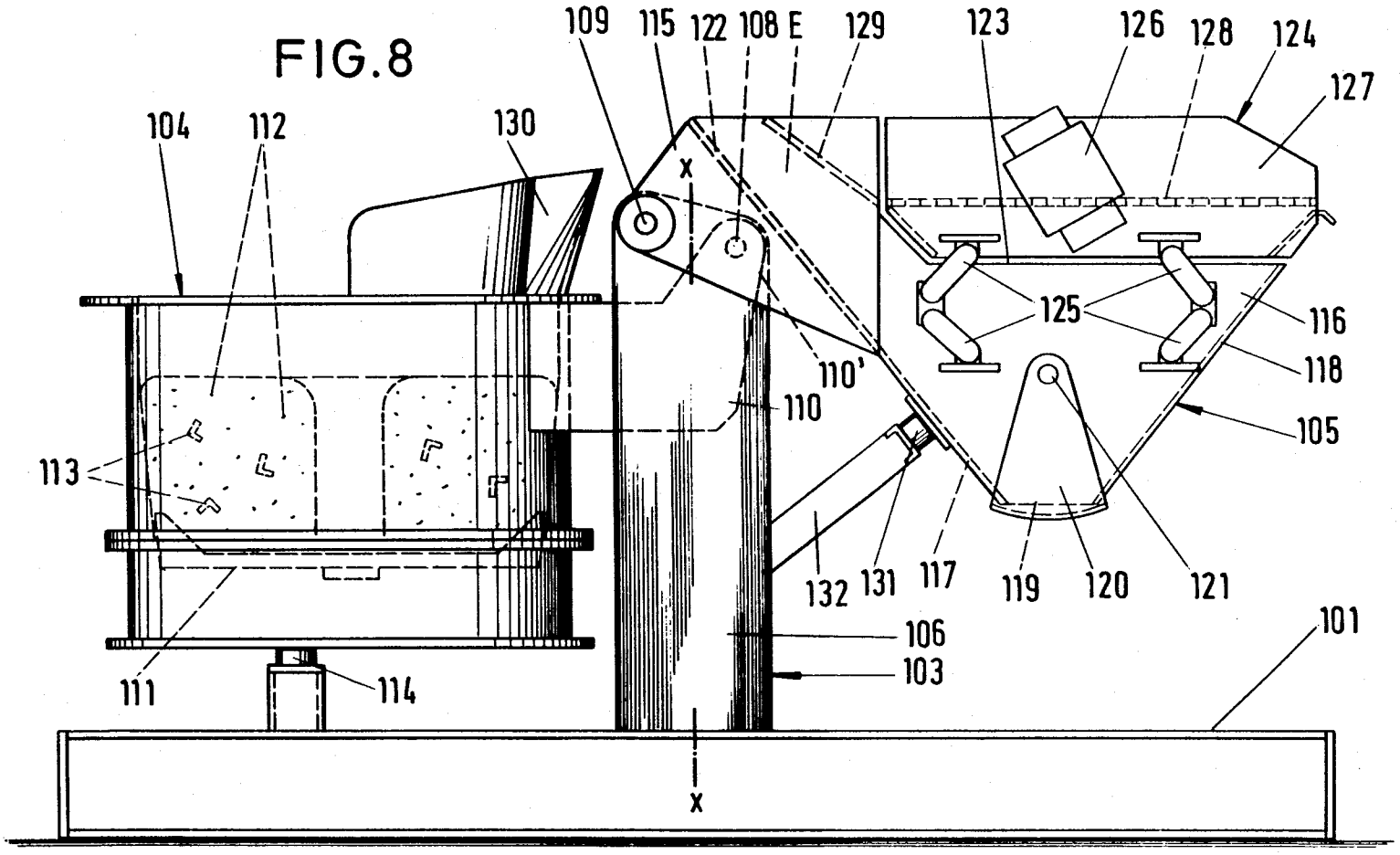
FIG. 8 is a side view of the apparatus in accordance with the second embodiment during the grinding of the workpieces in the slide-grinding container.
Figure 9:
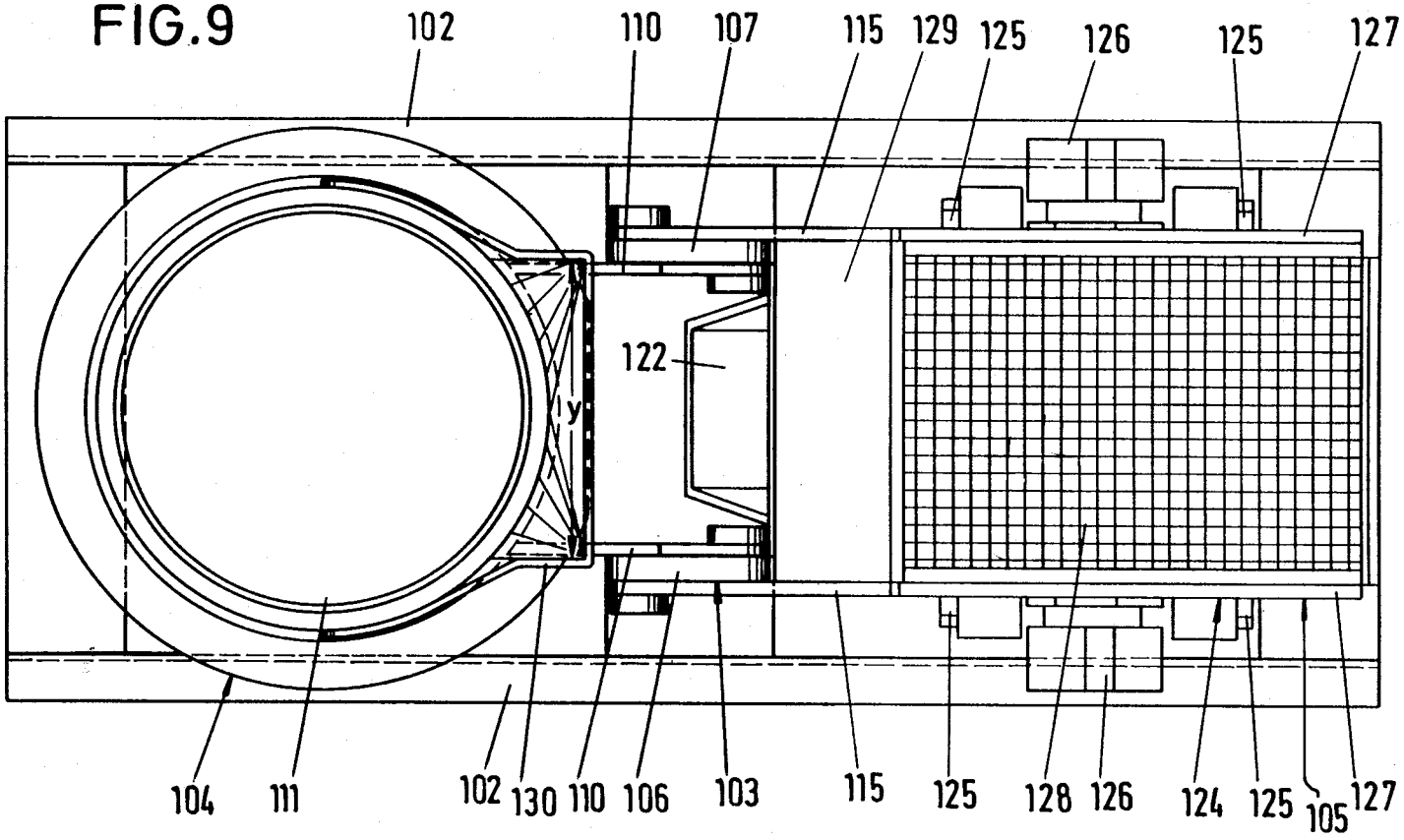
FIG. 9 is a top view of this apparatus.

The bottom 117 continues into an emptying chute 122 which extends over the tilt axis 108; see FIG. 8.

The region of the upper edge of the side walls 116 is cut out adjoining the bearing lugs 115. The space created by the cut-out 123 serves for providing a screening path 124. The latter is supported under spring action with respect to the collection chamber 105. For this purpose, spring elements 125 are provided both on the collection chamber 105 and on the screening path 124. The screening path 124 is placed in oscillation by vibratory drives 126, arranged on the outside thereof. The screening path 124 has two side walls 127 arranged parallel to each other, between which a screen 128 is held. Adjoining the latter, between the bearing lugs 115, there is a ramp 129 which is arranged above the emptying chute 122 and descends obliquely with respect to the screen 128. In this way, the emptying opening E, shaped in the manner of a spout, is formed between the emptying chute 122 and the ramp 129.

The edge of the slide-grinding container 104 is provided with a chute 130. It extends over a part of the circumference of the slide-grinding container which faces the machine frame 103 in such manner that the inside width y of the chute 130 is larger than the width of the spout-shaped emptying opening E; see FIG. 9.

The basic position of the collection chamber 105, in which the screen 128 of the screening path 124 extends horizontally, is defined by stops 131 which are fastened on arms 132 of the individual columns 106, 107.

Figure 10:
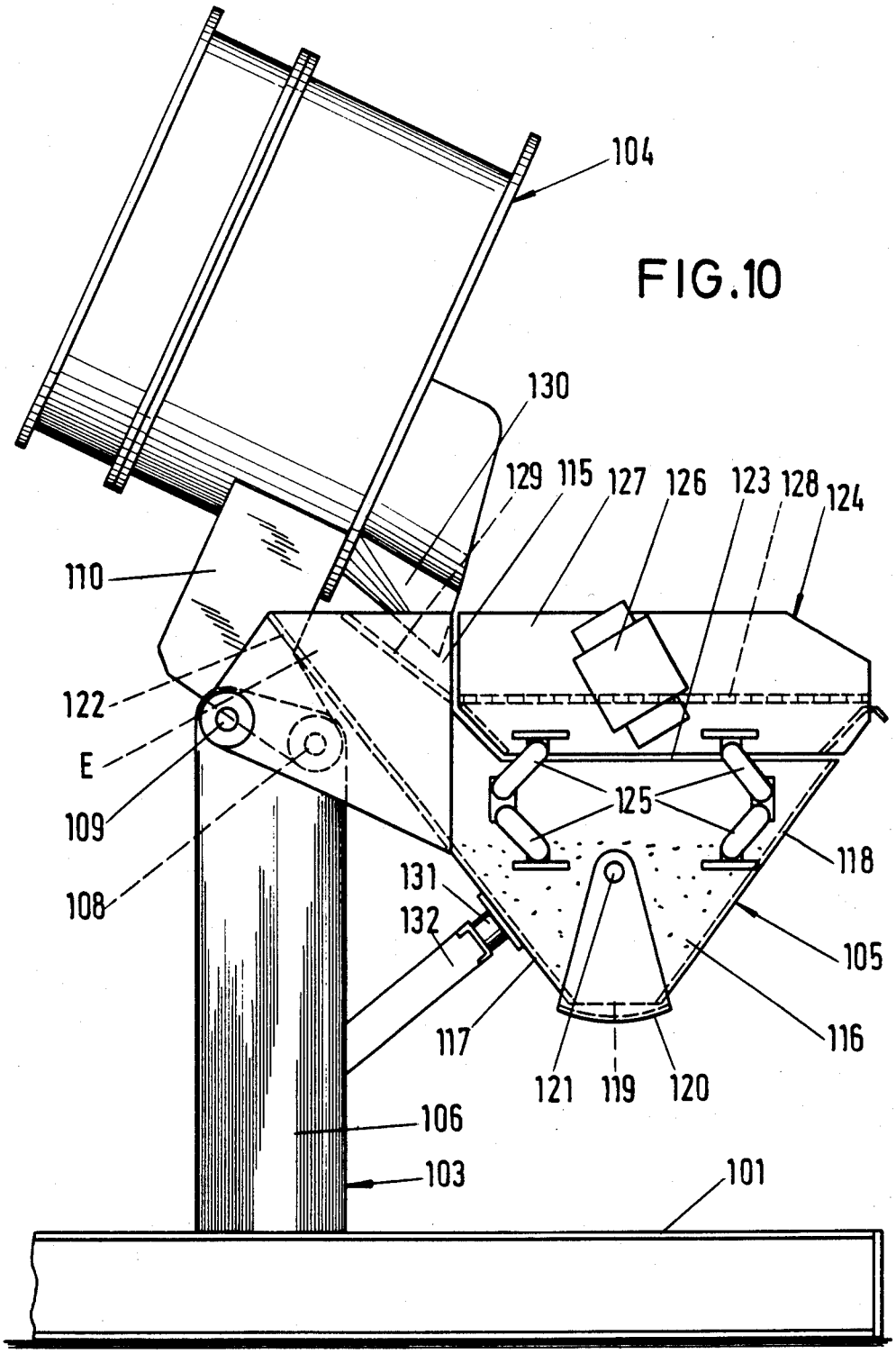
FIG. 10 is a view corresponding to FIG. 8, in which the slide-grinding container has been swung into the emptying position.

When, after completion of the surface treatment, the workpieces 113 present in the slide-grinding container 104 are to be emptied from the slide-grinding container 104, the latter is swung into the position shown in FIG. 10. This can be done by means of an incorporated drive or a separate drive. During this tilting displacement, the chute 130 moves over the spout-shaped emptying opening E, so that the chute then lies above the ramp 129. The contents of the container can now flow, via the ramp 129, onto the screen 128 with the avoidance of any abrupt drop which would endanger the quality of the surface of the workpieces. During this process, the screening path 124 is placed in vibration, so that the abrasive bodies 112 drop through the screen 128, while the workpieces 113 travel in the direction towards the discharge opening of the screen path.

Figure 11:
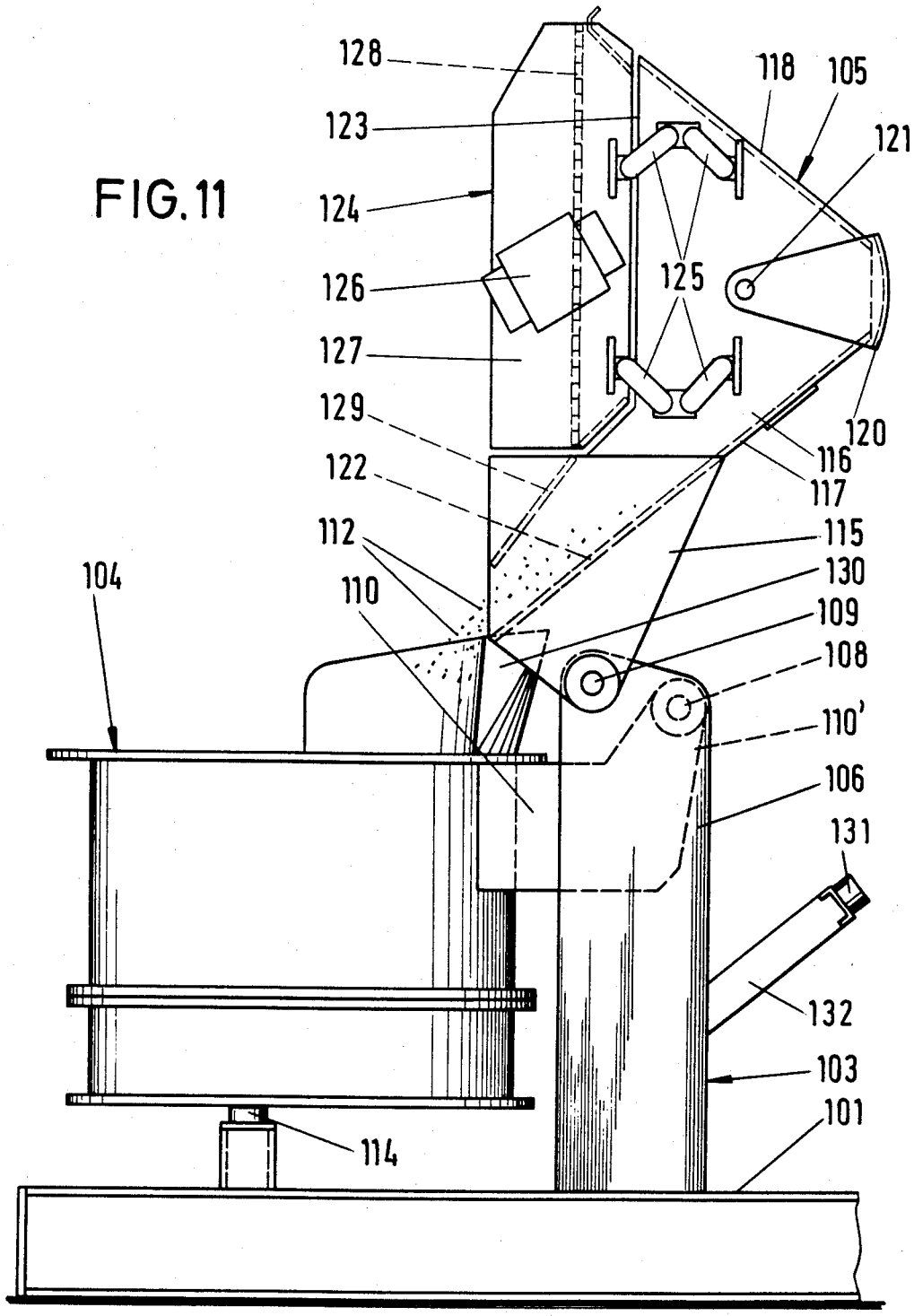
FIG. 11 is a view corresponding to FIG. 8, in which the collection chamber has been tilted into the return position.

After separation, the slide-grinding container 104 and the collection chamber 105 are tilted into the position shown in FIG. 11. In this connection it is possible to utilize the potential energy inherent in the slide-grinding container 104 in order to raise the collection chamber 105, as a result of which the corresponding energy requirement is reduced. The spout-shaped emptying opening E passes into the region between the lateral chute walls so that the abrasive bodies 112 flow back out of the emptying opening E into the slide-grinding container 104. Here also, swinging of the collection chamber 105 through a large angle, which leads to complete emptying, is possible.

When the return of the machining bodies has been completed, the collection chamber 105 can be brought back into the basic position shown in FIG. 8 and workpieces can again be introduced into the slide-grinding container 104 so that the next abrasive grinding operation can start.

We claim:

1. In an apparatus for slide grinding having a slide-grinding container which is movable upwardly in a tilting movement from a slide-grinding position thereof around a horizontal tilt axis into an emptying position thereof above a screen which is adapted to be placed in vibration and is arranged in an upper region of a collection container which is tiltable in a direction opposite the tilting movement of the slide-grinding container into an emptying position of the collection container above the slide-grinding container, and a collection chamber of the collection container arranged below the screen having a first chute which terminates above the slide-grinding container in the emptying position of the collection chamber, the chute defining an emptying opening for returning abrasive bodies which have fallen through the screen into the slide-grinding container, the improvement wherein said collection container and said slide-grinding container are tiltable independently of each other, said screen is formed as a screen chute, and means for vibrating said screen chute relative to said collection container.

2. The apparatus according to claim 1, further comprising a cylindrical shaft defines said tilt axis about which both said slide-grinding container and said collection container are tiltably mounted, a partial section of a cylindrical surface of the shaft constitutes a transition slide-surface from the slide-grinding container to said screen chute.

3. The apparatus according to claim 1, wherein said screen chute has a workpiece discharge opening and extends over part of the length of an upper edge region of said collection chamber in a direction of said workpiece discharge opening opposite the tilt axis.

4. The apparatus according to claim 3, wherein said means comprises, spring means for supporting said screen chute, a vibration drive for vibrating said screen chute, and said spring means resiliently connects said screen chute and said collection chamber.

5. The apparatus according to claim 1, wherein the collection container tapers down towards a bottom thereof forming a bottom emptying opening, and a bottom flap pivoted for swinging motion closes said bottom emptying opening.

6. The apparatus according to claim 1, further comprising a step in said collection container forming a recess adjacent said emptying opening, a closure flap for closing said emptying opening is pivotally mounted at an end thereof which faces away from the tilt axis and has a freely movable end thereof which faces said tilt axis, said freely movable end extends in said recess when said closure flap closes said emptying opening.

7. The apparatus according to claim 6, wherein said collection chamber forms said step.

8. The apparatus according to claim 1, further comprising a shaft defining said tilt axis, a slide surface between said tilt axis and said slide-grinding container obtusely adjoins an upper edge of said slide-grinding container terminating at a level of a partial section of said shaft, a closure flap for closing the emptying opening is coordinated with said shaft such that said shaft forms a roof ridge with respect to said closure flap and said slide surface.

9. The apparatus according to claim 5, wherein said collection chamber is mounted pivotally about said tilt axis.

10. The apparatus according to claim 1, comprising a machine frame having a vertical central axis, the tilt axis for the slide-grinding container is arranged on the collecting-chamber-side of said vertical central axis, and a second tilt axis for the collection chamber is arranged on the slide-grinding-container side of the vertical central axis of the machine frame, said collection container is tiltable about said second tilt axis.

11. The slide-grinding machine according to claim 10, wherein said second tilt axis of the collection chamber is located higher than said tilt axis for the slide-grinding container.

12. The slide-grinding machine according to claim 10, wherein said slide-grinding container has an edge above a part of its periphery facing the machine frame, said edge is formed as a second chute.

13. The slide-grinding machine according to claim 10, wherein said machine frame is formed as a column between said slide-grinding container and said collection chamber.

14. The slide-grinding machine according to claim 12, further comprising a ramp in said collection chamber above said first chute descending obliquely relative to the screen, and said second chute is tiltable above said ramp.

* * * * *